United States Patent [19]

Dixon

[11] 4,193,464

[45] Mar. 18, 1980

[54] REPLACEABLE SHIRTTAIL

[75] Inventor: Robert L. Dixon, Brea, Calif.

[73] Assignee: Smith International, Inc., Irvine, Calif.

[21] Appl. No.: 903,811

[22] Filed: May 8, 1978

[51] Int. Cl.[2] ..... E21B 9/08

[52] U.S. Cl. ..... 175/364; 175/53; 175/372

[58] Field of Search ..... 175/344, 346, 347, 334, 175/335, 371, 372, 364, 367, 368, 363, 53

[56] References Cited

U.S. PATENT DOCUMENTS

| | | | |
|---|---|---|---|
| 930,758 | 8/1909 | Hughes | 175/363 X |
| 1,995,388 | 3/1935 | Howard | 175/371 X |
| 2,030,722 | 2/1936 | Scott | 175/344 |
| 2,044,549 | 6/1936 | Scott | 175/363 X |
| 2,103,583 | 12/1937 | Howard et al. | 175/344 |
| 2,107,626 | 2/1938 | Catland | 175/363 X |
| 2,203,998 | 6/1940 | O'Grady | 175/344 X |
| 4,036,314 | 7/1977 | Dixon et al. | 175/364 |

*Primary Examiner*—James A. Leppink
*Assistant Examiner*—Richard E. Favreau
*Attorney, Agent, or Firm*—Christie, Parker & Hale

[57] ABSTRACT

A removable shirttail of an earth boring tool, such as a hole opener, protects the seals and bearings of an associated cutter. In one embodiment, the shirttail attaches to a journal or mounting shaft of the cutter by threaded fasteners. In an alternate embodiment, different threaded fasteners that attach the journal to an associated leg of the tool cooperate with the cutter and the leg to clamp the shirttail between the journal and the leg. A wedge-shaped boss of the shirttail faces the wall of the bore being opened. A V-shaped saddle in the boss receives a complementary lug of the journal. The lug of the journal also mates with a complementary notch of the leg to prevent journal rotation. The removal of the theaded fasteners that attach the journal to the leg allows spacers or shims to be withdrawn, which in turn permits the cutter, journal, and shirttail to be moved along the journal axis to clear a nose of the journal from a bore in a central body of the tool. The cutter, journal, and shirttail can then be lifted from the tool. Removed, the shirttail can be replaced, and seals and bearing of the cutter assembly inspected without the renewal of other parts of the cutter assembly or yoke.

18 Claims, 5 Drawing Figures

REPLACEABLE SHIRTTAIL

BACKGROUND OF THE INVENTION

The present invention relates to earth boring tools and, more particularly, to such earth boring tools as hole openers, raise drills, and big hole cutters.

Earth boring tools typically include cutters mounted to rotate on journals or mounting shafts. Some of these cutters define the diameter of the hole being bored. These diameter defining cutters are known as gage row cutters. Viewed in the vertical, the axis of the journal of each gage row cutter extends laterally from the vertical rotational axis of the tool and at an acute angle to a plane normal to this vertical axis. Gage row cutters are typically in the form of truncated cones and have steel teeth or tungsten carbide inserts on their conical faces for engaging and cutting the rock. The orientation of the cones presents only a point of the cutter to the full bore diameter at any instant of time. Rotation of the tool about the vertical axis rotates the cutters on formation rock and the cutters crush material in their path. The central portion of the hole may be drilled by a conventional rock bit, connected to the drilling apparatus, or the control portion of the hole may be a pilot bore previously made.

The outer cutters are known as gage row cutters because they determine the diameter of a hole being bored. Very little wear at the gage row can be tolerated because the hole diameter must be set within narrow tolerances. However, the rate of wear of the cutter at the gage row is comparatively great. This is so because the cutters rotate at a comparatively high rate of speed due to their extreme radial position from the axis of rotation of the tool. Also the gage row cutters do most of the boring work and are in a zone where cuttings accumulate and abrade their cutting surfaces. For protection against the harsh abrasive environment adjacent to the peripheral wall of the hole being drilled, a shirttail forms a wear surface just inside of the radial extreme of each cutter and at the end of a yoke leg that supports one end of the cutter. The shirttails cover the cutters except for that small section that sees full gage diameter.

Cutters typically are mounted on their journals by bearings and these bearings are protected by seals. Loss of the seals can cause loss of lubricant, or intrusion of abrasive material, or both, causing loss of the bearings. It is desirable to be able to inspect and replace, if necessary, the cutter's seals without renewing its bearings so that the life of the cutter can be extended.

The yoke legs of the rock drilling tool that support the outer radial end of the gage row cutters tend to wear rapidly on their outer radial surfaces, even when these surfaces are formed of wear resistant shirttails. With the shirttail integral with the legs, it is difficult to replace the leg, especially in the field. With the shirttail integral with the journal of the gage row cutter, a sound journal, entirely machined and heat treated, would have to be replaced with a worn shirttail. Excessive wear of the shirttail also exposes the bearing seal, causing rapid loss of the seal.

It is thus highly desirable to be able to remove shirttails without affecting cutter mounting legs or journals.

SUMMARY OF THE INVENTION

The present invention provides a detachable shirttail and an earth boring tool with the detachable shirttail that are especially valuable in shielding a rotary cutter of the tool in particularly high abrasive content formations.

In one form, the present invention contemplates an earth boring tool having a rotary gage cutter to define the gage diameter of the hole being bored. Such a tool may be a raise drill, a hole opener, or large hole drill. The cutter mounts on a journal or shaft and rotates about the axis of the journal. The axis is at an acute angle to the radius of the cylindrical wall being developed by the tool and the gage cutter is shaped so that the extreme radial periphery of the cutter intersects the wall only along a few degrees of arc. The balance of the cutter is radially inside the gage diameter. The shirttail covers a portion of the cutter adjacent the cylindrical hole wall and protects it from abrasion. The cutter mounts to the tool in a yoke having a radial outboard leg positioned to be adjacent the cylindrical wall of the hole. The shirttail forms an end of this leg. The cutter and its journal removably mount in the yoke, as by threaded fasteners. The shirttail is removably mounted on the balance of the tool, preferably to the journal that mounts the gage cutter. Shirttail renewal, and seal and bearing inspection are therefore easy and inexpensive.

In one form, a base of the shirttail includes a ring that shields and retains a bearing seal of the cutter and journal. In an alternate form, the ring is not used.

In a more specific form, the present invention contemplates an earth boring tool having a yoke, a journal secured to the yoke so that the journal cannot rotate about its axis, a gage cutter cone rotatably mounted on the journal, and a shirttail secured to the shaft at an end of a radially external leg of the yoke. The shirttail has a boss with an external, axially extending surface conforming in placement and curvature to the surface of the leg of the yoke from which it depends. The journal mounts at an acute angle with respect to the rotational axis of the tool as a whole, typically on the vertical, and a plane normal to that axis. The axis of rotation of the cutter is at this angle. Thus, the rotational axis of the cutter has components both radial and axial of the tool rotational axis. The cutter intersects the cylindrical wall of the hole being bored only for a small amount of arc. The boss has a noncircular saddle that bears against a conforming lug at the end of the cutter journal so that forces tending to rotate the shirttail are transferred to the journal. The end of the external yoke leg has a noncircular notch receiving a complementary shaped surface of the lug so as to prevent rotation of the journal about its axis. The notch of the end of the leg and the saddle of the shirttail can be opposed V-shaped so that together they form a hole of a square cross section, and the lug can be square in cross section. Threaded fasteners recessed in the boss of the shirttail may attach the shirttail to the journal. The journal attaches to the leg of the yoke, as by more threaded fasteners. A nose of the journal fits into a bore or recess on an internal leg of the yoke, which internal leg may be the body of the boring tool. A spacer bears against the journal and the inside of the external yoke leg to position the cutter within the yoke and lock it there. When the fastener used to secure the journal to the yoke is removed, the spacer can be removed permitting the cutter and journal to move along the axis of the journal so that the nose of the journal clears the recess in the internal leg of the yoke. The cutter, journal and shirttail can then be removed for selective repair and inspection.

The embodiment of the shirttail having a ring and a retainer uses the ring in mounting the shirttail to the tool. The ring is adapted to be sandwiched between the yoke leg and the cutter, typically with spacers between the ring and the yoke leg. The ring receives on the journal so that the shirttail is constrained in five degrees of freedom. The sixth degree of freedom is constrained by the noncircular saddle and the lug of the journal.

The present invention provides a means for field servicing of earth boring tools of the type which employ rotary cutters by providing a wear surface that can be readily replaced and, specifically, by providing a shirttail which can be removed and therefore renewed in the field. The removable shirttail means that wear of the yoke and on the end of the cutter mounting journal are reduced. Costly replacements of the entire assembly of the journal, bearings and seals does not occur as often. Yoke and journal replacement are not as frequent as with an integral shirttail. The retainer and the shield at the base of the shirttail in one embodiment covers a seal of a cutter assembly, retains the seal, and permits easy inspection and any necessary renewal of the seal when the shirttail is removed. Direct attachment of the shirttail to the journal accurately positions the shield and retainer of the shirttail with respect to the adjacent seal of the cutter assembly.

These and other features, aspects and advantages of the present invention will become more apparent from the following description, appended claims and drawings.

DESCRIPTION OF THE PREFERRED EMBODIMENT

Figure 1:
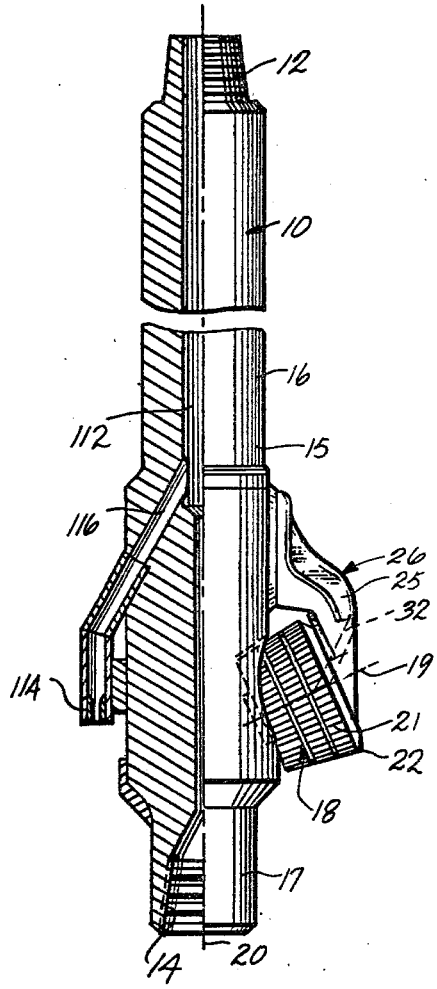
FIG. 1 illustrates a hole opener constructed in accordance with a preferred embodiment of the present invention. The view is in elevation and partly in half-section.

In FIG. 1, a hole opener 10 has a threaded pin 12 at its upper end for connection to a drill string. The hole opener is shown only partially and somewhat schematically. Female threads 14 at the base of the hole opener can accept the threaded pin of a rock bit. The hole opener includes a body 15 of an elongated upper shank 16 and a lower shank 17, the latter defining threads 14. The hole opener may have a number of gage cutters, typically three, of which one is shown at 18. A typical raise drill with which this invention can be used is shown in U.S. Pat. No. 4,007,799 and a hole opener is shown in U.S. Pat. No. 4,036,314. These patents are incorporated herein by this reference.

The embodiment described and illustrated herein relates to a hole opener substantially as described and illustrated in the aforementioned patent. Cutter 18 is conical on its cutting face and rotates about an axis 19 as hole opener 10 rotates about its axis, which is shown at 20. Axis 19 is oriented at an acute angle to axis 20 and planes perpendicular to axis 20. Axis 19 does not intersect axis 20. Consequently, cutter 18 scrapes formation material while it rotates about its axis 19.

The cutter illustrated has a plurality of teeth 21 that extend along axis 19. Alternatively, tungsten carbide inserts can be used in place of teeth 21. A gage diameter for the hole opener is defined by the point on the cutter furthest from hole opener axis 20. This gage diameter is shown at reference numeral 22.

Gage diameter 22 must be maintained within close tolerances to maintain gage of the hole, and the design of the cutters takes this into account.

Figure 2:
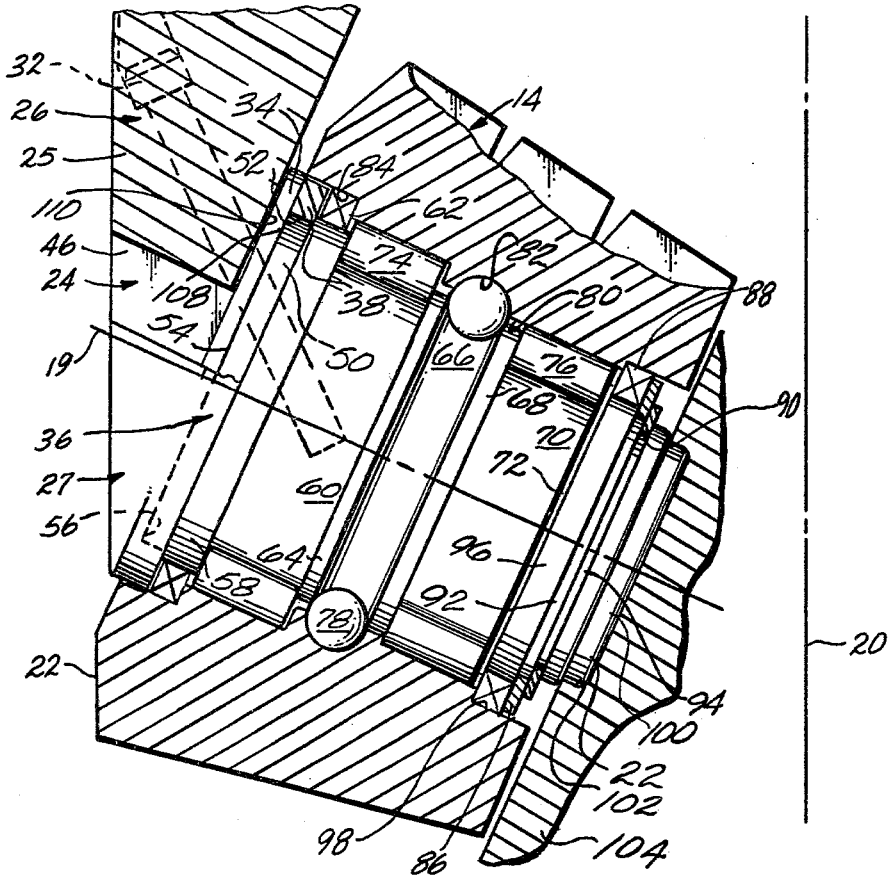
FIG. 2 illustrates a portion of the earth boring tool of FIG. 1, partly in half-section, partly broken away, and somewhat schematically.

With reference to both FIGS. 1 and 2, cutter 18 mounts on a shaft, pin, or journal 24, that attaches into a leg 25 of a yoke 26 of the hole opener. Cutter 18 rotates on journal 24, but the journal does not rotate on its mounts.

Figure 3:
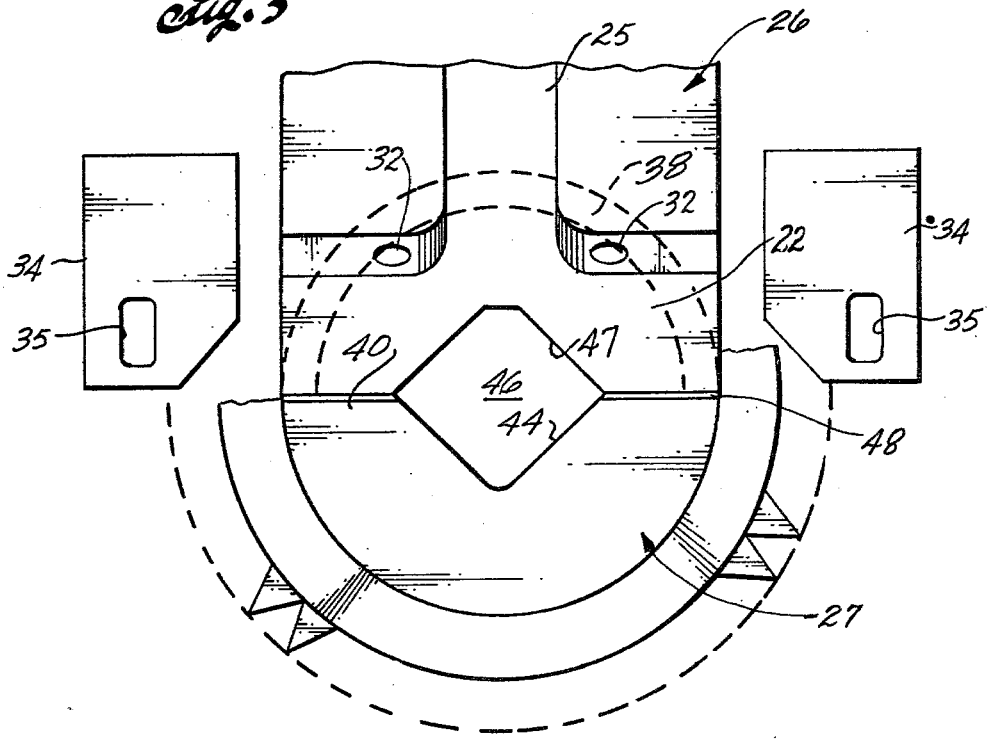
FIG. 3 views the shirttail and a portion of an exterior leg of the boring tool of FIG. 1, with spacers shown exploded.

As seen particularly in FIGS. 2 and 3, a shirttail 27 attaches to the journal and leg 25 in a manner to be described. Journal 24 attaches to a leg 25 of yoke 26 by a pair of threaded bolts 32 passing angularly through the leg and into the journal. Removal of journal mounting bolts 32, and a pair of shims or spacers 34, having slots 35 through which the bolts pass, permits withdrawal of the cutter and journal together with the shirttail. Such a mounting arrangement is described in U.S. Pat. No. 4,036,314.

The shirttail is in a zone next to the cylindrical wall of the hole where a lot of wear can be expected. The cuttings generated by the cutters abrade the exterior surface of the shirttail. The shirttail protects the journal and bearings of the cutter located between the shirttail and the journal and so its presence is important. The ability to remove the shirttail avoids having to renew an end of the yoke leg or to renew an entire cutter assembly of the cutter and journal and permits inspection of bearings and seals.

Shirttail 27 has a generally cylindrical base 36 formed of a shield and retaining ring 38. The ring shields and retains a seal on the journal. In FIG. 2, the ring is clearly visible at an upper half, but is hidden by a boss 40 of the shirttail. A V-shaped slot or saddle 44 in boss 40 mates with the sides of a square lug 46 on the outboard end of journal 24. The outboard leg of the yoke has a V-shaped notch 47 facing the V-shaped saddle of the shirttail and the notch receives square lug 46. The lug, then, cannot rotate about cutter axis 19 or within leg 25. The V-shaped saddle of the shirttail helps prevent rotation of the shirttail by interference with square lug 46. Loads on the shirttail parallel to the axis of the hole opener and towards the leg will be taken by the leg through the lug.

As seen in FIG. 3, slight clearance 48 between boss 40 and leg 25 assures that the lug and saddle engage.

The exterior surface of boss 40 is curved to conform to the exterior cylindrical curvature of the hole opener 10. Likewise, the exterior surface of lug 46 has such a curvature. The thick end of the wedge-shaped shirttail is adjacent the end of leg 25. The thin end of the shirttail is axially remote from the end of the leg.

Cutter mounting journal 24 has a circular step 50 received in a hollow space 52 that is radially inside shirttail shield and retaining ring 38. Step 50 locates and retains the shirttail concentric with axis 19. The step meets a deep shoulder 54 at the end of the step remote from axis 20 and proximate leg 25. This shoulder abuts against an interior surface 56 of the shirttail which underlies boss 40. A circular retaining flange 58 of greater diameter than step 50 is also one land of a roller bearing race 60. Flange 58 constrains the ring from moving toward the cutter. A proximate surface of leg spacer 34 keeps the shield and retaining ring from moving in the opposite direction away from the cutter. The interference of saddle 44 with lug 46 constrains the shirttail from rotating about axis 16.

A circular seal 62 mounts on flange 58. Shield and retaining ring 38 protect seal 62. When the shirttail is removed, shield and retaining ring 38 uncovers seal 62 and the seal can readily be inspected and changed if necessary.

A flange 64 defines the second land of race 60 and the land for a circular ball race 66. A land 68 forms the complementary land for the ball race 66 and a land of a second roller race 70. Finally, a circular flange 72 forms the complementary land for the second roller race 70. Rollers 74 in race 60, rollers 76 in race 70, and balls 78 in race 66 provide the bearings of the cutter. The roller bearings act between an interior, multiple-stepped bore 80 of cutter 18 and their races. The steps of the cutter complement the bearing major diameters of the shaft bearing sets to form bearing surfaces. A circular race 82 provides the track for the balls 78. A circular groove 84 seats seal 62 and receives the shield and retainer ring 38. A retainer 86 retains a seal 88 at the radially interior end of the journal 24. A spring clip 90 keeps the retainer 86 and the seal 88 in place. A circular step 92 receives retainer 86, and a circular groove 94 in this step receives the spring clip. A circular step 96 receives seal 88. A circular groove 98 in the cutter seats seal 88. A nose 100 of the cutter mounting shaft 24 is received in a bore 102 in an inboard base 104 of cutter yoke 26 which is formed of body 15. Inboard base 104 may be a part of a comparatively massive main body of the tool as illustrated, or it may be a separate yoke leg on an outboard gage cutter of a large raise drill.

As seen in FIG. 3, the pair of spacers or shims 34 keep the cutter, journal and shirttail in the yoke and bear between a face 108 at one end of the journal and an interior face 110 of the outboard leg 25. These spacers have slots 35 in them that pass threaded fasteners 32 so that the spacers are retained in place. For service, the fasteners 32 are removed and this permits spacers 34 to be pulled out from their positions laterally away from cutter axis 19. The assembly of cutter 18, journal 24, and shirttail 27 can now be displaced along cutter axis 19 towards outboard leg 25 of yoke 26 so that nose 100 clears recess 102 in the inboard base. With this shift, the assembly can be removed from the yoke by pulling it out of the yoke. The shirttail can then be renewed, seal 62 can be inspected and renewed if necessary, and the entire assembly put back together in reverse order.

The shirttail can be case-hardened, faced with hard facing deposit, or be provided with wear resistant inserts, if desired.

The bearings and journal 24 need not be replaced because of shirttail damage. Journal life can therefore be greatly extended. Seals 62 and 88 can be inspected and replaced without dismantling the cutter, bearing, and journal assembly. Alternate approaches which require the removal of a leg of the yoke are therefore avoided with advantage.

With reference again to FIG. 1, the hole opener further includes an axial passage 112 in communication with a nozzle 114 through a passage 116. Drilling mud through the passage and out the nozzle aids in the formation of a hole by cooling the cutters and removing cuttings.

Figure 4:
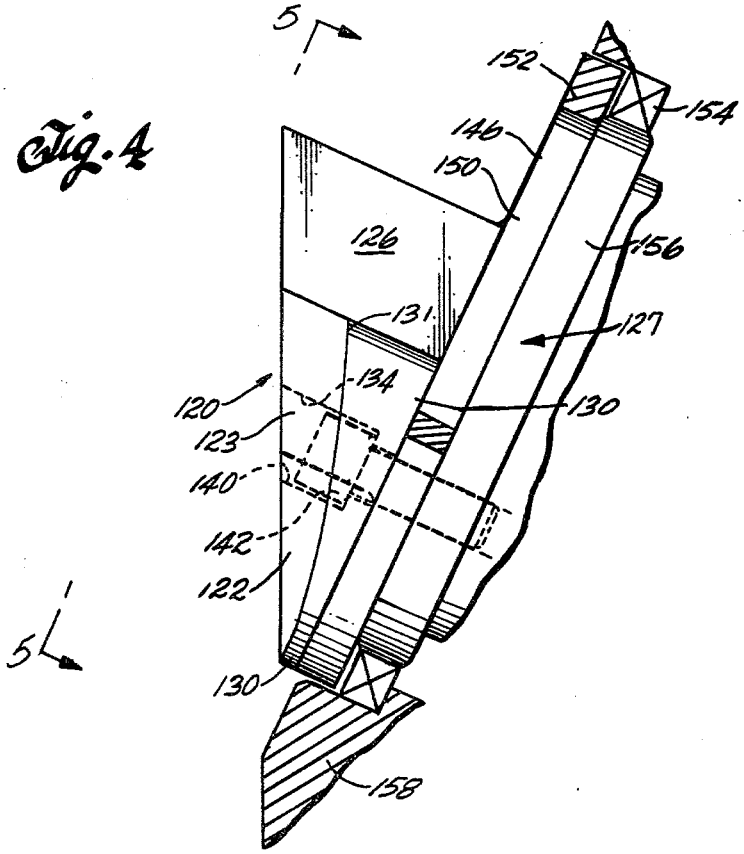
FIG. 4 illustrates an alternate embodiment of the shirttail of the present invention partly in half-section and partly broken away together with portions of a cooperating cutter and cutter journal.
Figure 5:
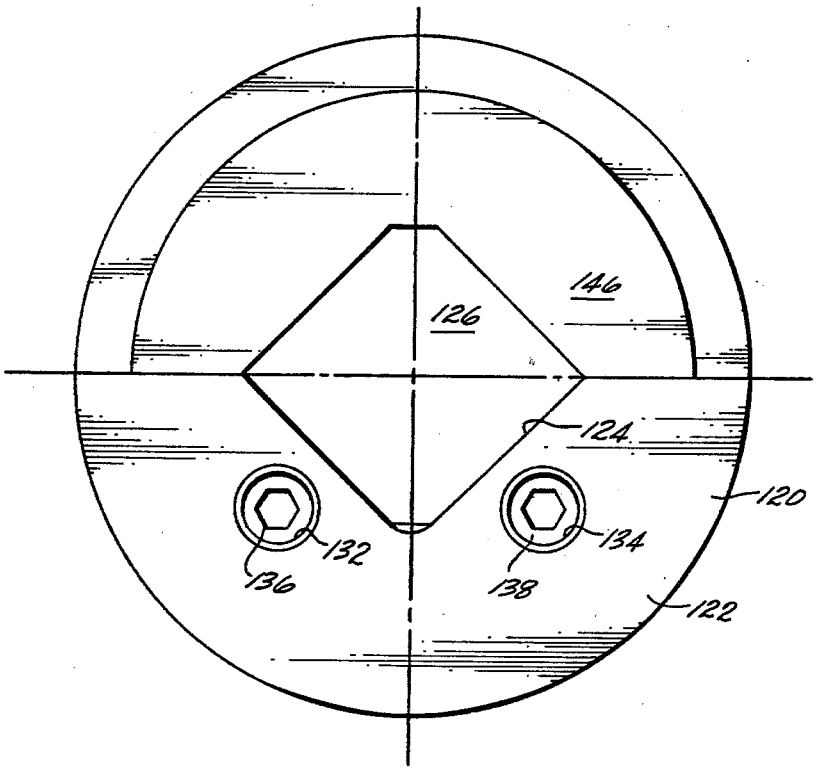
FIG. 5 views the shirttail and environment of the tool of FIG. 4 along lines 5—5 of that Figure.

FIGS. 4 and 5 illustrate the alternate embodiment of the shirttail of the present invention. The shirttail is shown in general by reference numeral 120. The shirttail has a boss 122, as before. A V-shaped in cross section saddle 124 in the boss receives a complementary shaped lug 126 of a mounting journal 127 of the cutter used with the shirttail. As before, the curvature of the outer surface of the shirttail has a radius of curvature from the axis of the hole opener. Such an axis is similar to axis 20 in the embodiment described previously. As seen in FIG. 4, the sides of the shirttail are cylindrical. The same cylindrical configuration attends the first described embodiment. As before, the boss is generally wedge-shaped. As seen in the Figures, fastener receiving holes 132 and 134 in the shirttail pass through the boss. Fasteners 136 and 138 are received in these holes. The heads of these fasteners bottom on a shoulder of a counterbore of each of the holes, as can be seen in FIG. 4. There, a counterbore 140 of hole 134 has a shoulder 142 against which the head of fastener 138 bears.

Lug 126 forms an end of cutter mounting journal 127. Lug 126 is square in cross section. As in the previously described embodiment, the lower portion of the lug engages complementary surfaces of the saddle. The upper surfaces of the lug engage complementary V-shaped surfaces of the end of a leg of the yoke in the manner of the first described embodiment. Thus journal 146 cannot rotate.

As can be seen in FIG. 4, journal 146 has a cylindrical step 150 that receives a retainer and shield ring 152. This ring is not integral with the shirttail. The retainer and shield ring protects a seal 154 that is received on a circular step 156 of journal 127 of greater diameter than step 150. The journal mounts a cutter 158. The relationship of the cutter to the journal is the same as that of the first described embodiment and therefore will not be repeated here.

As in the first described embodiment, the assembly of the shirttail, journal, cutter, and bearings is held in a yoke of the hole opener. Spacers just like spacers 34 and fasteners just like fasteners 32 lock the assembly in place.

The present invention has been described with reference to a preferred embodiment. The spirit and scope of the appended claims should not, however, necessarily be limited to the foregoing description.

What is claimed is:

1. In an earth boring tool of the type having a rotary cutter, a shirttail having a base to protect the rotary cutter from the wall of a bore being formed in the earth, and an axis of rotation, an improvement comprising:

a journal forming a rotational axis of the cutter;

means for mounting the cutter on the journal for rotation about the rotational axis of the cutter, such means including bearing means between the cutter and the journal;

means for removably mounting the journal and cutter to the balance of the tool such that the cutter rotates at an acute angle to the wall of the bore with only a portion of the cutter intersecting the wall and with the balance of the cutter being radially inward of the wall, such mounting means including a yoke, the yoke having radially spaced-apart legs, the leg of the larger radius having an end surface with a radial component and an acircular in cross section notch in the end surface, the journal having an acircular in cross section lug received by the notch, whereby the journal cannot rotate with respect to the leg;

means for preventing the journal from rotating with respect to the yoke;

seal means between the bearing means and the yoke leg of larger radius; and means for removably mounting the shirttail to the balance of the tool to protect the cutter from the wall of the bore, the base of the shirttail shielding the cutting means.

2. The earth boring tool claimed in claim 1 wherein the base of the shirttail includes a ring, the journal having a step receiving the ring, the step being between the seal means and the yoke leg of larger radius.

3. The earth boring tool claimed in claim 2 wherein the means for removably mounting the shirttail to the balance of the tool includes means on the journal and means on the leg of the larger radius confining the ring between them.

4. The earth boring tool claimed in claim 3 wherein the confining means on the journal includes a land of the journal adjacent the step and the confining means of the leg includes a surface of the leg.

5. The earth boring tool claimed in claim 1 wherein the means for removably mounting the shirttail to the balance of the tool includes means for mounting the shirttail to the journal.

6. The earth boring tool claimed in claim 5 wherein the means for preventing the journal from rotating with respect to the yoke includes a lug on the outer end of the journal extending radially from the cutter below the leg of the yoke of larger radius, the lug having a cross section normal to the axis of rotation of the cutter that is noncircular, and the end of the leg of the yoke of larger radius having a noncircular surface complementary to and in bearing with the noncircular lug.

7. The earth boring tool claimed in claim 6 wherein the shirttail has a saddle that is noncircular normal to the axis of rotation of the cutter and which receives a complementary curved surface of the lug.

8. The earth boring tool claimed in claim 1 wherein the means for removably mounting the shirttail to the balance of the tool includes means for mounting the shirttail to the journal.

9. The earth boring tool claimed in claim 8 wherein the shirttail has a boss, the boss being generally wedge-shaped and having a surface for facing the wall of the bore being bored that is cylindrically curved with a radius from the axis of rotation of the tool, the rotational axis of the cutter extending upwardly from the axis of rotation of the earth boring tool, the thick part of the wedge being adjacent the leg of larger radius and the thin part of the wedge being remote from such leg.

10. An earth boring apparatus comprising:

a body;

a yoke of the body having a leg located radially-outward of an associated portion of the body and a noncircular notch at an end of the leg;

a cutter having a rotational axis;

a journal concentric with the axis of the cutter;

means removably securing the journal in the yoke between the leg and the associated portion of the body and in fixed position relative to the body;

a lug on an outer radial end of the journal, the lug having a surface mating with the noncircular notch to prevent rotation of the journal with respect to the body, the noncircular notch being aligned with the axis of the journal;

a protective shirttail at the end of the leg and radially outward of the cutter, the shirttail overlying a substantial portion of the cutter to protect the cutter from the wall of a hole being bored by the apparatus, the shirttail also having a noncircular in cross section saddle that complements the cross section of the lug and that receives the lug so as to transfer rotational loads on the shirttail to the journal and restrain rotation of the shirttail; and means releasably securing the shirttail to the leg through the journal.

11. The apparatus according to claim 10 including bearing means between the journal and the cutter to facilitate rotation of the cutter, and seal means between the bearing means and the environment to protect the bearing means, a shield and retaining ring of the shirttail shielding the seal means and retaining the seal means.

12. The apparatus according to claim 11 wherein the rotational axis of the cutter is at an acute angle to the rotational axis of the body, the shirttail having an outer wear surface extending generally parallel to the axis of rotation of the body, and the shield and retaining ring of the shirttail parallels the end of the cutter adjacent the ring and is normal to the axis of rotation of the cutter.

13. The apparatus claimed in claim 10 wherein means securing the journal to the yoke include removable fastener means attaching the journal to the leg.

14. The apparatus claimed in claim 10 wherein the means for removably securing the journal to the yoke includes the journal having a nose and the portion of the body associated with the leg having a bore in receipt of the nose of the journal, means for preventing translation of the cutter on the journal, and spacer means between the cutter and the leg secured in place by the removable fastener, the spacer means having a thickness along the axis of the journal at least as great as the depth of receipt of the nose in the bore, whereby removal of the fastener means attaching the journal to the leg frees the spacer means for removal, removal of the spacer means permits the journal, cutter, and shirttail to be translated along the axis of the journal to free the nose from the bore and permit withdrawal of the journal, cutter, and shirttail from the yoke.

15. A replacement shirttail for an earth boring tool having at least one rotary cutter mounted for rotation on a shaft and a yoke having a mounting leg for mounting the shaft of such a cutter, the shaft having a noncircular in cross section lug, the shirttail comprising:

(a) a boss having a wear surface for facing the wall of a hole being bored by the tool;

(b) a base integral with the boss and having a surface adapted to lie adjacent to an end of the cutter, the wear surface and base surface being at an acute angle to each other so that the shirttail is generally wedge-shaped with a thick end of the wedge being adapted for adjacency to the mounting leg and a thin end of the wedge being remote from the mounting leg;

(c) a noncircular in cross section saddle through the boss and base for nonrotational receipt of the lug; and (d) means for removably connecting the base portion to the shaft.

16. The replacement shirttail claimed in claim 15 wherein the means for connecting includes at least one counterbored aperture for receiving a fastener.

17. The replacement shirttail claimed in claim 15 including:

a retaining and shielding ring integral with the base for retaining and shielding a bearing seal between the shaft and cutter.

18. The replacement shirttail claimed in claim 17 wherein the means for connecting includes the ring, the ring being adapted for receipt on the shaft.

* * * * *

UNITED STATES PATENT AND TRADEMARK OFFICE

CERTIFICATE OF CORRECTION

PATENT NO. : 4,193,464

DATED : March 18, 1980

INVENTOR(S) : Robert L. Dixon

It is certified that error appears in the above-identified patent and that said Letters Patent are hereby corrected as shown below:

In the claims: Claim 10, column 7, line 58, "radially-outward" should be --radially outward--. Claim 14, column 8, line 31, "to" should be --in--.

Signed and Sealed this

*Twenty-fourth* Day of *June 1980*

[SEAL]

*Attest:*

SIDNEY A. DIAMOND

*Attesting Officer*

*Commissioner of Patents and Trademarks*